US009752465B2

(12) United States Patent
Hayashi

(10) Patent No.: US 9,752,465 B2
(45) Date of Patent: Sep. 5, 2017

(54) VALVE TIMING CONTROLLER

(71) Applicant: DENSO CORPORATION, Kariya, Aichi-pref. (JP)

(72) Inventor: Masashi Hayashi, Okazaki (JP)

(73) Assignee: DENSO CORPORATION, Kariya (JP)

( * ) Notice: Subject to any disclaimer, the term of this patent is extended or adjusted under 35 U.S.C. 154(b) by 139 days.

(21) Appl. No.: 14/825,415

(22) Filed: Aug. 13, 2015

(65) Prior Publication Data

US 2016/0061063 A1 Mar. 3, 2016

(30) Foreign Application Priority Data

Sep. 3, 2014 (JP) ..... 2014-179128
Jun. 19, 2015 (JP) ..... 2015-123808

(51) Int. Cl.
*F01L 1/34* (2006.01)
*F01L 1/344* (2006.01)

(52) U.S. Cl.
CPC ..... *F01L 1/34* (2013.01); *F01L 1/3442* (2013.01); *F01L 2001/3443* (2013.01); *F01L 2001/34433* (2013.01); *F01L 2001/34469* (2013.01); *F01L 2250/02* (2013.01); *F01L 2820/01* (2013.01)

(58) Field of Classification Search
CPC ... F01L 1/34; F01L 1/3442; F01L 2001/3443; F01L 2001/34433; F01L 2001/3445; F01L 2001/34469; F01L 2820/01
USPC ..... 123/90.15
See application file for complete search history.

(56) References Cited

U.S. PATENT DOCUMENTS 8,464,756 B2 * 6/2013 Navale ..... F16K 11/0708 137/625.67
8,695,548 B2 * 4/2014 Kato ..... F01L 1/3442 123/90.15
2007/0101962 A1 5/2007 Tsukada et al.
2013/0192551 A1 8/2013 Hayashi

FOREIGN PATENT DOCUMENTS

JP 9-89136 3/1997
JP 2000-337113 12/2000
JP 2003-286813 10/2003
JP 4487263 6/2010
JP 2011-179385 9/2011

* cited by examiner

*Primary Examiner* — Phutthiwat Wongwian
*Assistant Examiner* — Loren Edwards
(74) *Attorney, Agent, or Firm* — Nixon & Vanderhye PC

(57) ABSTRACT

A valve timing controller has a housing, a vane rotor, a valve body and a spool. The valve body has a supply port to communicate with an external oil feed section, a first drain port to communicate with a first oil pressure chamber, and a second drain port to communicate with a second oil pressure chamber. The supply port includes a supply recess recessed outward in a radial direction from an inner wall surface of a pipe part of the valve body. The second drain port includes a drain recess recessed outward in the radial direction from the inner wall surface of the pipe part. A depth of the drain recess in the radial direction is smaller than a depth of the supply recess in the radial direction.

12 Claims, 16 Drawing Sheets

VALVE TIMING CONTROLLER

CROSS REFERENCE TO RELATED APPLICATION

This application is based on Japanese Patent Application No. 2014-179128 filed on Sep. 3, 2014 and Japanese Patent Application No. 2015-123808 filed on Jun. 19, 2015, the disclosures of which are incorporated herein by reference in their entirety.

TECHNICAL FIELD

The present disclosure relates to a valve timing controller.

BACKGROUND

A hydraulic valve timing controller controls valve timing of an intake/exhaust valve of an internal combustion engine by discharging operation oil from one chamber in a housing and by supplying operation oil to the other chamber in the housing to relatively rotate a vane rotor. JP 2013-151923 A (corresponding to US 2013/0192551 A1) describes a valve timing controller in which operation oil is supplied and discharged by an oil passage directional control valve disposed at the central part of the vane rotor. The oil passage directional control valve has a valve body with a based cylindrical shape and a spool movable in an axial direction inside the valve body. A drain space is defined by the spool and the valve body. The operation oil of oil pressure chamber is discharged through the drain port of the valve body to a drain oil passage including the drain space.

In recent years, it is required to raise the control speed of valve timing to raise the performance of internal combustion engine. In JP 2013-151923 A, a check valve is disposed in a supply oil passage to restrict the operation oil from flowing backwards from the oil pressure chamber to the supply oil passage. Moreover, in order to flow a large amount of the operation oil, an annular groove is defined on the inner side of each port of the valve body, such that the port open area is increased relative to a stroke of the spool.

SUMMARY

In case where the valve timing controller has the check valve, when a rotation phase of a vane rotor is held relative to a housing, due to the check valve, the oil pressure in oil pressure chamber can be maintained comparatively high that is almost the same as that of supply oil. From this state, if operation oil is discharged from the oil pressure chamber through the drain port located on the bottom side of the valve body, the oil pressure in the drain oil passage near the drain port becomes high and a large amount of the operation oil flows into the drain oil passage, because the difference pressure is large between the oil pressure chamber and the drain oil passage and because the open area of the drain port is rapidly increased by the effect of annular groove. Therefore, the high oil pressure of the operation oil of the drain oil passage acts on the spool which defines a part of the drain oil passage (drain space) with the valve body. Further, the spool receives the fluid force by the operation oil with the large flow rate in the drain oil passage. In this case, the spool becomes unstable and the accuracy of controlling the rotation phase of vane rotor may fall.

It is an object of the present disclosure to provide a valve timing controller which can accurately control a rotation phase of a vane rotor.

A valve timing controller disposed in a passage where a driving force is transmitted from a driving shaft to a driven shaft of an internal combustion engine to control a valve timing of a valve driven to open and close by the driven shaft includes a housing, a vane rotor, a valve body and a spool. The housing is rotatable with one of the driving shaft and the driven shaft. The vane rotor is rotatable with the other of the driving shaft and the driven shaft. The vane rotor has a vane part that divides an interior space of the housing into a first oil pressure chamber on one side in a circumferential direction and a second oil pressure chamber on the other side in the circumferential direction. The valve body has a based cylindrical shape arranged coaxially with the vane rotor at a central part of the vane rotor. The valve body has a supply port to communicate with an external oil feed section, a first drain port to communicate with the first oil pressure chamber, and a second drain port to communicate with the second oil pressure chamber. The spool is movable in an axial direction inside of the valve body. The spool and the valve body define a drain space. The spool opens the second drain port that is located adjacent to a bottom of the valve body than the first drain port is when discharging operation oil of the second oil pressure chamber to a drain oil passage which includes the drain space.

The supply port includes a supply recess recessed outward in a radial direction from an inner wall surface of a pipe part of the valve body. The second drain port includes a drain recess recessed outward in the radial direction from the inner wall surface of the pipe part. The drain recess has a depth in the radial direction, which is smaller than a depth of the supply recess in the radial direction.

When operation oil is discharged from the second oil pressure chamber through the second drain port located adjacent to the bottom of the valve body, pressure loss arises by narrowing the oil passage by the comparatively shallow drain recess. Thereby, excess discharge of the operation oil from the second drain port to the drain oil passage is controlled, and the oil pressure of the drain oil passage near the second drain port is restricted from becoming high. Thus, the spool can stably work and the rotation phase of vane rotor can be controlled accurately.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

Figure 1:
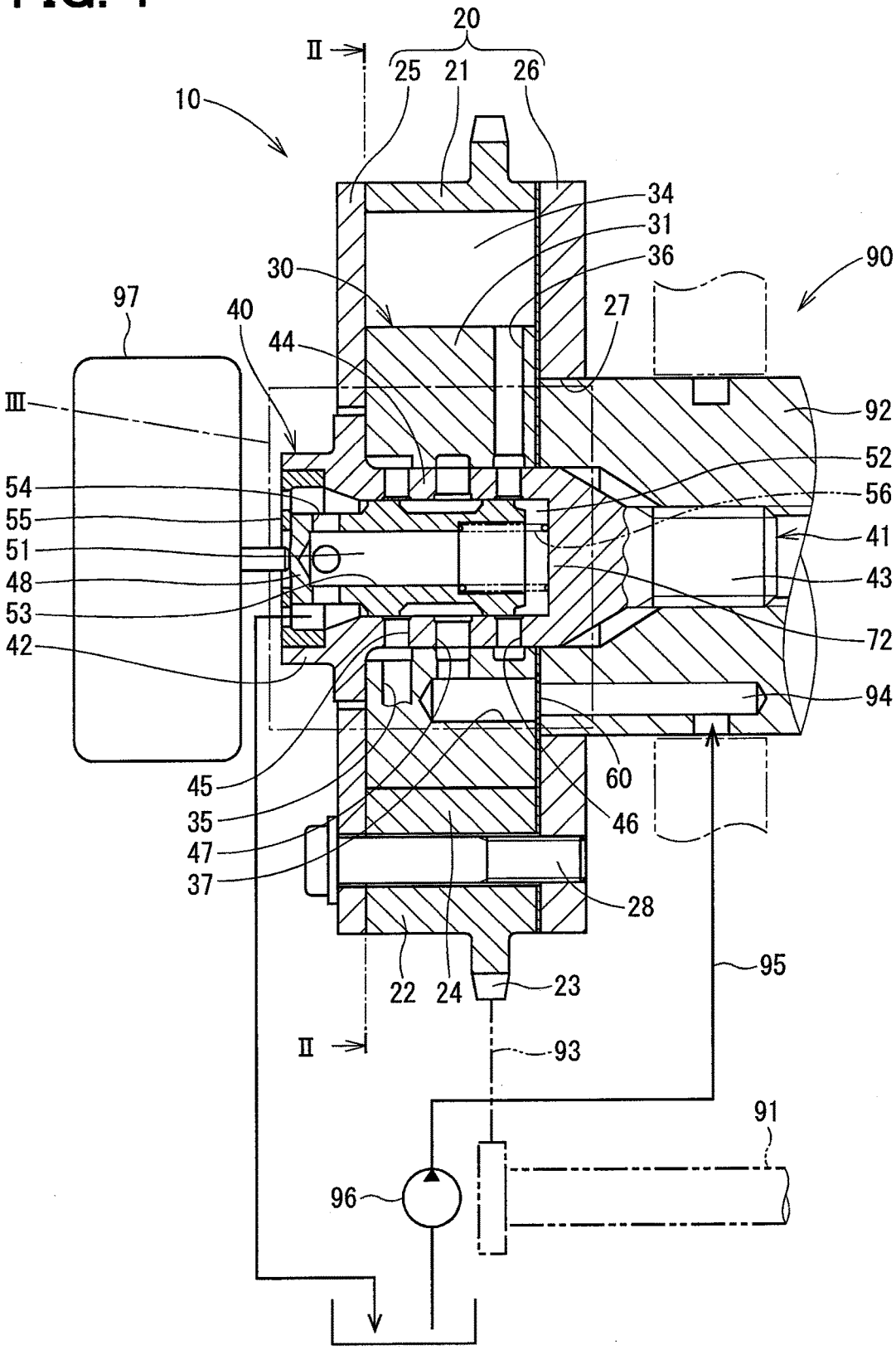
FIG. 1 is a schematic view illustrating a valve timing controller according to a first embodiment.

Embodiments of the present disclosure will be described hereafter referring to drawings. In the embodiments, a part that corresponds to a matter described in a preceding embodiment may be assigned with the same reference numeral, and redundant explanation for the part may be omitted. When only a part of a configuration is described in an embodiment, another preceding embodiment may be applied to the other parts of the configuration. The parts may be combined even if it is not explicitly described that the parts can be combined. The embodiments may be partially combined even if it is not explicitly described that the embodiments can be combined, provided there is no harm in the combination.

First Embodiment

A valve timing controller 10 of a first embodiment is shown in FIG. 1. The valve timing controller 10 controls valve timing of an intake valve (not shown) driven to open and close by a camshaft 92 by relatively rotating the camshaft 92 relative to a crankshaft 91 of an internal combustion engine 90. The valve timing controller 10 is disposed in a passage where a driving force is transmitted from the crankshaft 91 to the camshaft 92. The crankshaft 91 may correspond to a driving shaft, and the camshaft 92 may correspond to a driven shaft.

Figure 2:
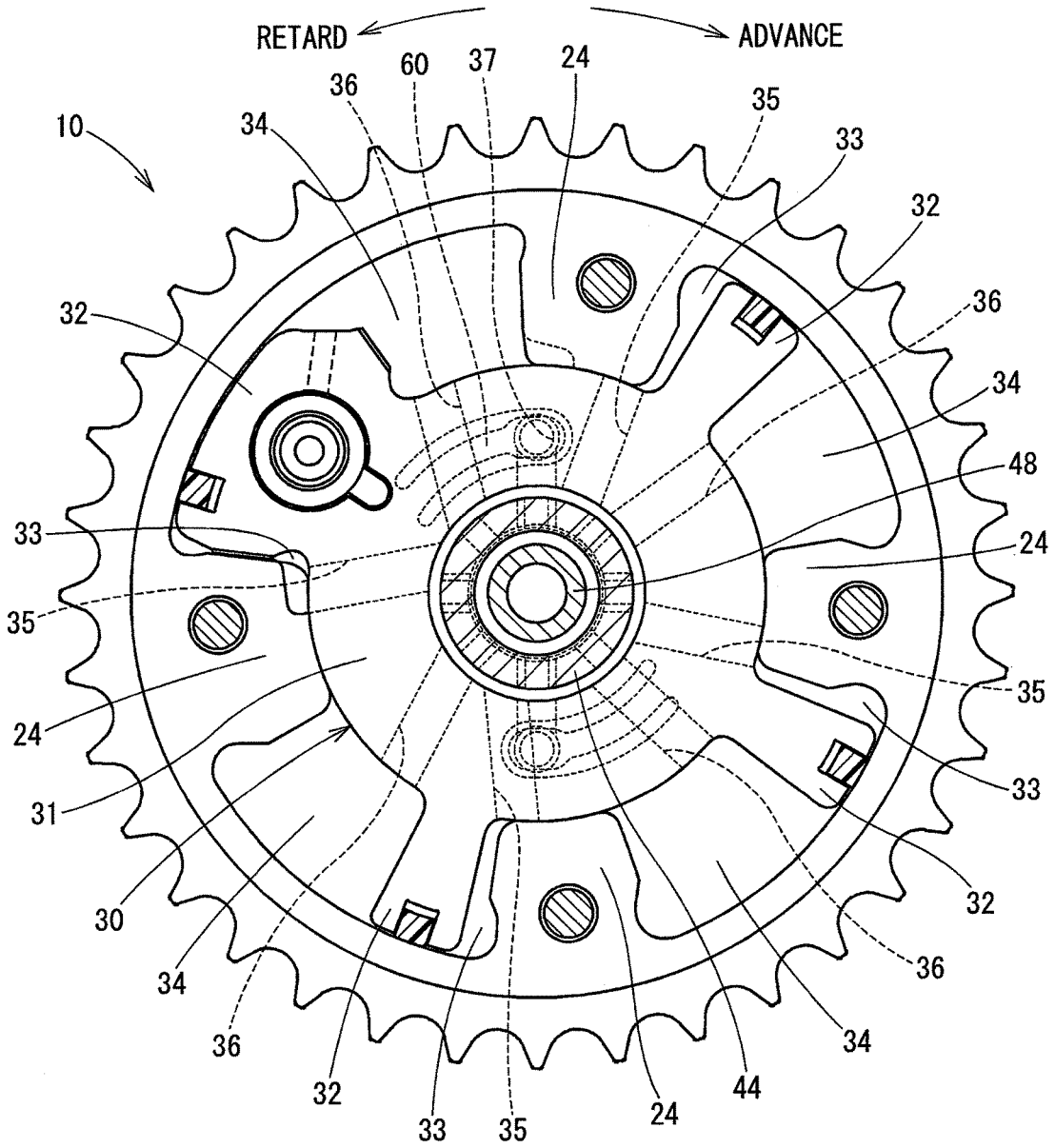
FIG. 2 is a sectional view taken along a line II-II FIG. 1.

The valve timing controller 10 is explained with reference to FIGS. 1-5. As shown in FIG. 1 and FIG. 2, the valve timing controller 10 is equipped with a housing 20, a vane rotor 30, an oil passage directional control valve 40, and a check valve 60.

The housing 20 has a sprocket 21, a front plate 25, and a rear plate 26.

The sprocket 21 is coaxially arranged with the camshaft 92, and extends in an axial direction of the camshaft 92. The sprocket 21 has a pipe part 22, an outside tooth part 23, and plural projection parts 24. The outside tooth part 23 is formed on the outer wall of the pipe part 22, and is connected with the crankshaft 91 through a timing chain 93. The projection part 24 is projected from the pipe part 22 inward in the radial direction.

The front plate 25 is arranged on one side of the sprocket 21 in the axial direction. The rear plate 26 is arranged on the other side of the sprocket 21 in the axial direction, and has a fitting hole 27 at the central part. The camshaft 92 is inserted in the fitting hole 27 of the rear plate 26. The sprocket 21, the front plate 25, and the rear plate 26 are fixed integrally with a bolt 28. The housing 20 is rotatable integrally with the crankshaft 91.

The vane rotor 30 is disposed in the housing 20, and is rotatable relative to the housing 20. The vane rotor has a boss part 31 and plural vane parts 32. The boss part 31 is fixed to the camshaft 92 with a sleeve bolt 28. The vane part 32 is projected outward in the radial direction from the boss part 31, and divides an interior space of the housing 20, i.e., the space between the two projection parts 24 of the sprocket 21, into an advance chamber 33 on one side in a circumferential direction and a retard chamber 34 on the other side in the circumferential direction. The advance chamber 33 may correspond to a first oil pressure chamber, and the retard chamber 34 may correspond to a second oil pressure chamber.

The vane rotor 30 has a supply oil passage 37, an advance oil passage 35, and a retard oil passage 36. One end of the advance oil passage 35 is connected to the advance chamber 33, and the other end of the advance oil passage 35 is opened in the inner wall surface of the boss part 31. One end of the retard oil passage 36 is connected to the retard chamber 34, and the other end of the retard oil passage 36 is opened in the inner wall surface of the boss part 31. One end of the supply oil passage 37 is opened in the end surface of the boss part 31 adjacent to the camshaft 92, and the other end of the supply oil passage 37 is opened in the inner wall surface of the boss part 31.

An external supply oil passage 94 of the camshaft 92 may be equivalent to an external oil feed section. For example, the external supply oil passage 94 communicates to an oil pump 96 through an oil passage 95 in an engine block. The supply oil passage 37 is connected to the external supply oil passage 94.

The vane rotor 30 is rotated relative to the housing 20 by receiving the pressure of the operation oil supplied to either the advance chamber 33 or the retard chamber 34, and changes the rotation phase relative to the housing 20 on the advance side or the retard side.

Figure 3:
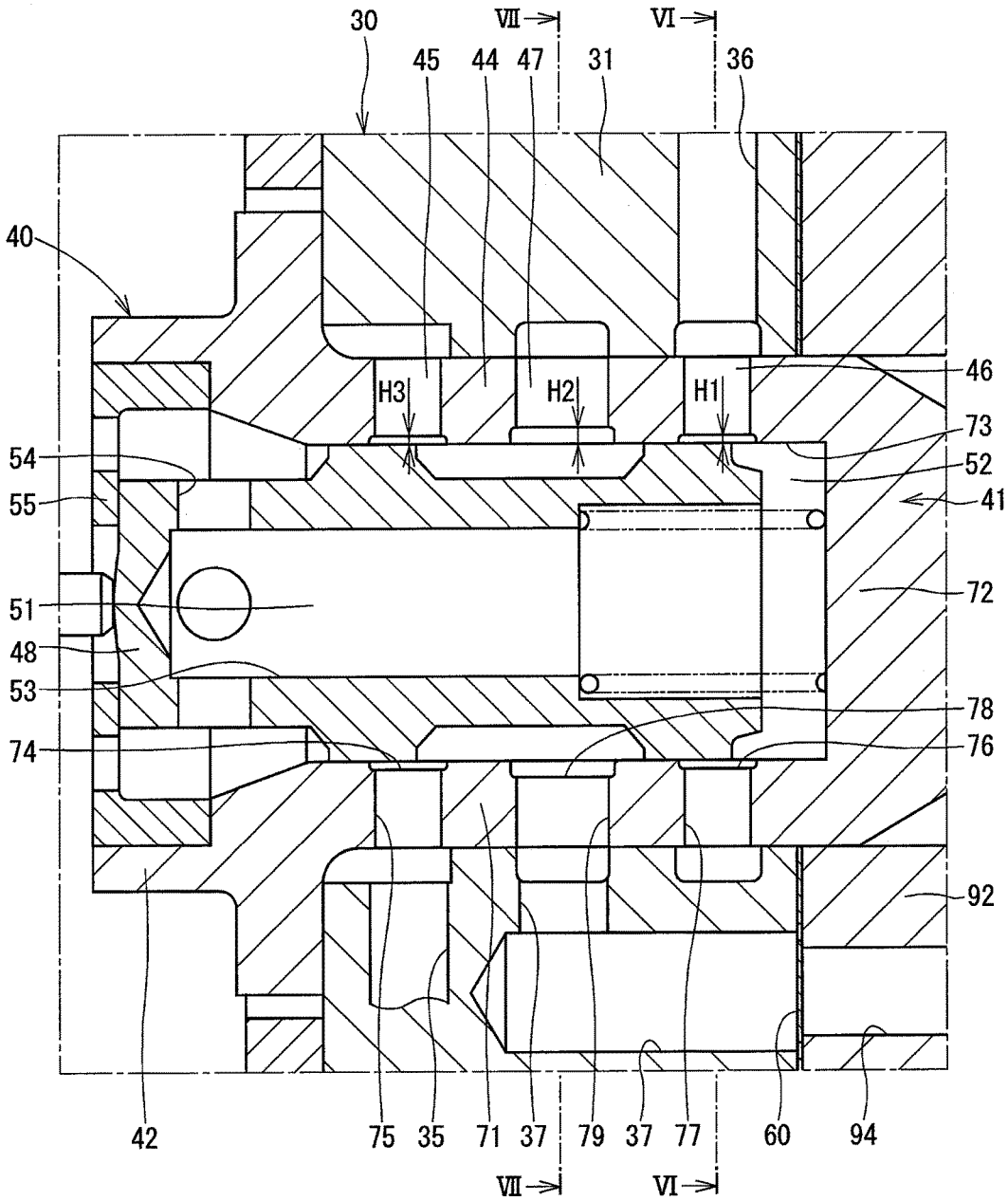
FIG. 3 is an enlarged sectional view showing an area III of FIG. 1, in which operation oil is discharged from a retard chamber and operation oil is supplied to an advance chamber.

As shown in FIGS. 1-3, the oil passage directional control valve 40 has a sleeve bolt 41 and a spool 48.

The sleeve bolt 41 is inserted in the vane rotor 30 from the opposite side opposite from the camshaft 92, and is thrust into the camshaft 92. The sleeve bolt 41 defines a valve body 44 located inside the vane rotor 30 between the head 42 and the screw part 43. The valve body 44 has the advance port 45 connected to the advance oil passage 35, the retard port 46 connected to the retard oil passage 36, and the supply port 47 connected to the supply oil passage 37.

The advance port 45 is a port to discharge operation oil from the oil passage directional control valve 40 to the advance chamber 33, and is also a port to discharge operation oil from the advance chamber 33. The advance port 45 may equivalent to a first drain port and a first discharge port.

The retard port 46 is a port to discharge operation oil from the oil passage directional control valve 40 to the retard chamber 34, and is also a port to discharge operation oil from the retard chamber 34. The retard port 46 may equivalent to a second drain port and a second discharge port.

The spool 48 is movable both-way in the axial direction, inside the valve body 44, and can connect selected ports of the valve body 44 according to the axial position. Specifically, when discharging operation oil from the retard chamber 34 and when supplying operation oil to the advance chamber 33, the spool 48 connects the supply port 47 and the advance port 45, and opens the retard port 46 to be connected to the drain oil passage 51. The drain oil passage 51 includes a drain space 52 defined by the inner wall surface of the valve body 44 and the end surface of the spool 48. The drain oil passage 51 includes a based hole 53 defined in the spool 48, and a through hole 54 passing through the spool 48 in the radial direction adjacent to the bottom of the based hole 53. When discharging operation oil from the advance chamber 33 and when supplying operation oil to the retard chamber 34, the spool 48 connects the supply port 47 and the retard port 46, and opens the advance port 45 to be connected to the drain oil passage 51.

The stopper plate 55 is fitted into the head 42 of the sleeve bolt 28, and the spool 48 is biased by the spring 56 toward the stopper plate 55. The axial position of the spool 48 is determined by a balance between the biasing force of the spring 56 and a drawing force of a movable member of a linear solenoid 97 disposed opposite from the spool 48 through the stopper plate 55.

The check valve 60 is supported between the camshaft 92 and the vane rotor 30. In this embodiment, the check valve 60 is a reed valve, and allows operation oil to flow from the external supply oil passage 94 to the supply oil passage 37 and prevents operation oil from flowing to the external supply oil passage 94 from the supply oil passage 37. Thereby, the operation oil of the supply oil passage 37 is prevented from flowing backwards to the external supply oil passage 94.

When the rotation phase is located on a retard side from a desired phase in the valve timing controller 10, as shown in FIG. 3, the operation oil of the retard chamber 34 is discharged, and operation oil is supplied to the advance chamber 33 by the oil passage directional control valve 40. Thereby, the vane rotor 30 is relatively rotated relative to the housing 20 on the advance side.

Figure 4:
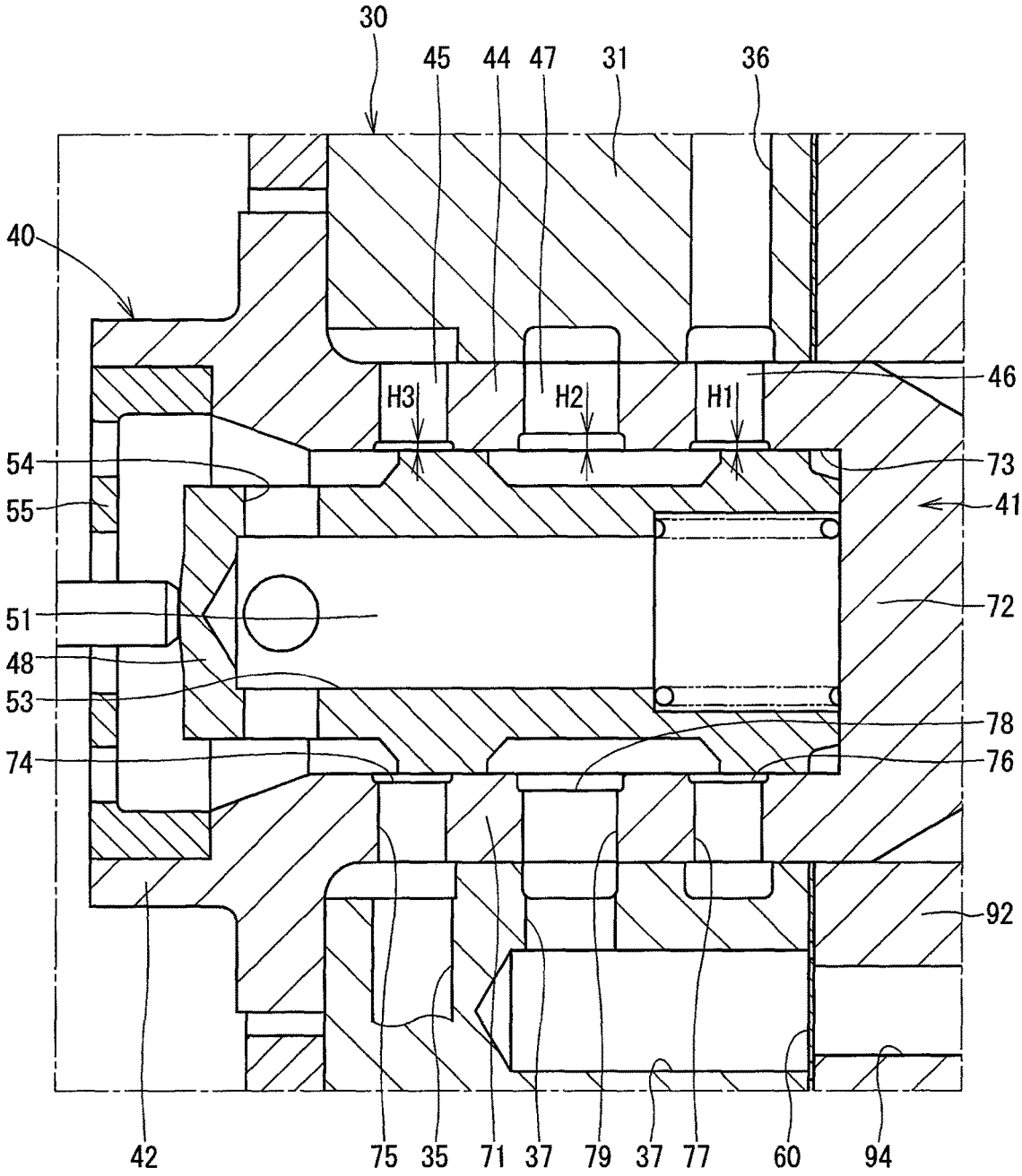
FIG. 4 is an enlarged sectional view showing an area III of FIG. 1, in which operation oil is discharged from the advance chamber and operation oil is supplied to the retard chamber.

When the rotation phase is located on an advance side from a desired phase, as shown in FIG. 4, the operation oil of the advance chamber 33 is discharged, and operation oil is supplied to the retard chamber 34 by the oil passage directional control valve 40. Thereby, the vane rotor 30 is rotated relative to the housing 20 on the retard side.

Figure 5:
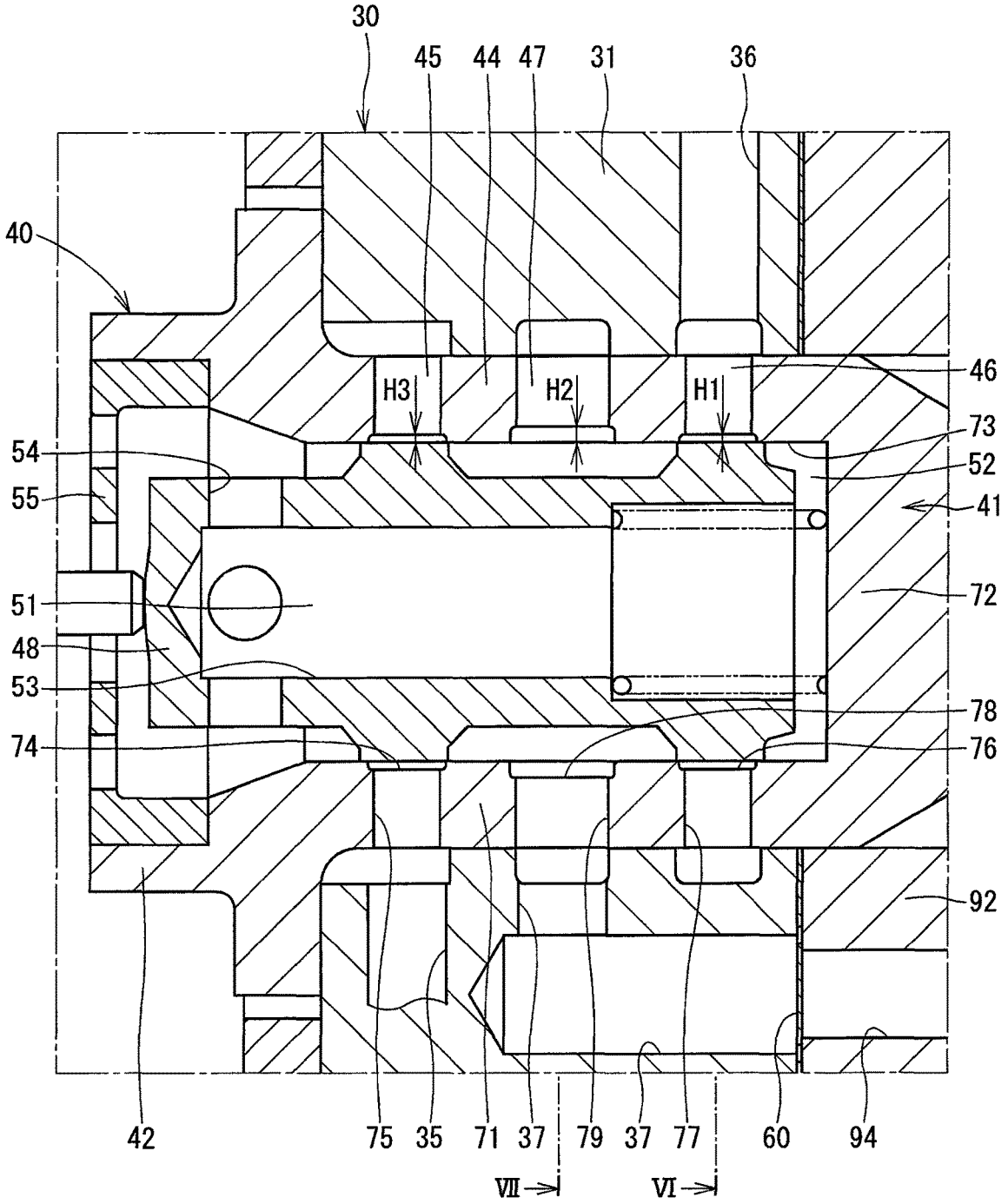
FIG. 5 is an enlarged sectional view showing an area III of FIG. 1, in which a rotation phase of a vane rotor is maintained.

When the rotation phase is in agreement with a desired phase, as shown in FIG. 5, the advance chamber 33 and the retard chamber 34 are closed by the oil passage directional control valve 40. Thereby, the rotation phase is maintained at the present position.

The valve timing controller 10 is explained in details with reference to FIGS. 1-8.

As shown in FIGS. 1-5, the valve body 44 has a based cylindrical shape. Specifically, the valve body 44 has the pipe part 71 and the bottom 72. The pipe part 71 is located coaxially with the vane rotor 30. The spool 48 slides in contact with the inner wall surface 73 of the pipe part 71. The bottom 72 is located adjacent to the screw part 43. The retard port 46 is located adjacent to the bottom 72 than the advance port 45 is. In this embodiment, the retard port 46, the supply port 47, and the advance port 45 are arranged in this order from the bottom 72. When discharging operation oil from the retard chamber 34, the retard port 46 communicates to the drain space 52.

The spool 48 has a based cylindrical shape. The open end of the spool 48 is located adjacent to the bottom 72 of the valve body 44. The bottom of the spool 48 is located adjacent to the stopper plate 55.

As shown in FIG. 2 and FIG. 3, the advance port 45 includes an advance recess 74 recessed outward in the radial direction from the inner wall surface 73 of the pipe part 71 of the valve body 44. In this embodiment, the advance port 45 includes the advance recess 74 that is an annular groove formed over all the circumferences of the valve body 44 around the axial center, and the plural through holes 75 extending radially from the advance recess 74. The advance recess 74 may equivalent to other drain recess.

Figure 6:
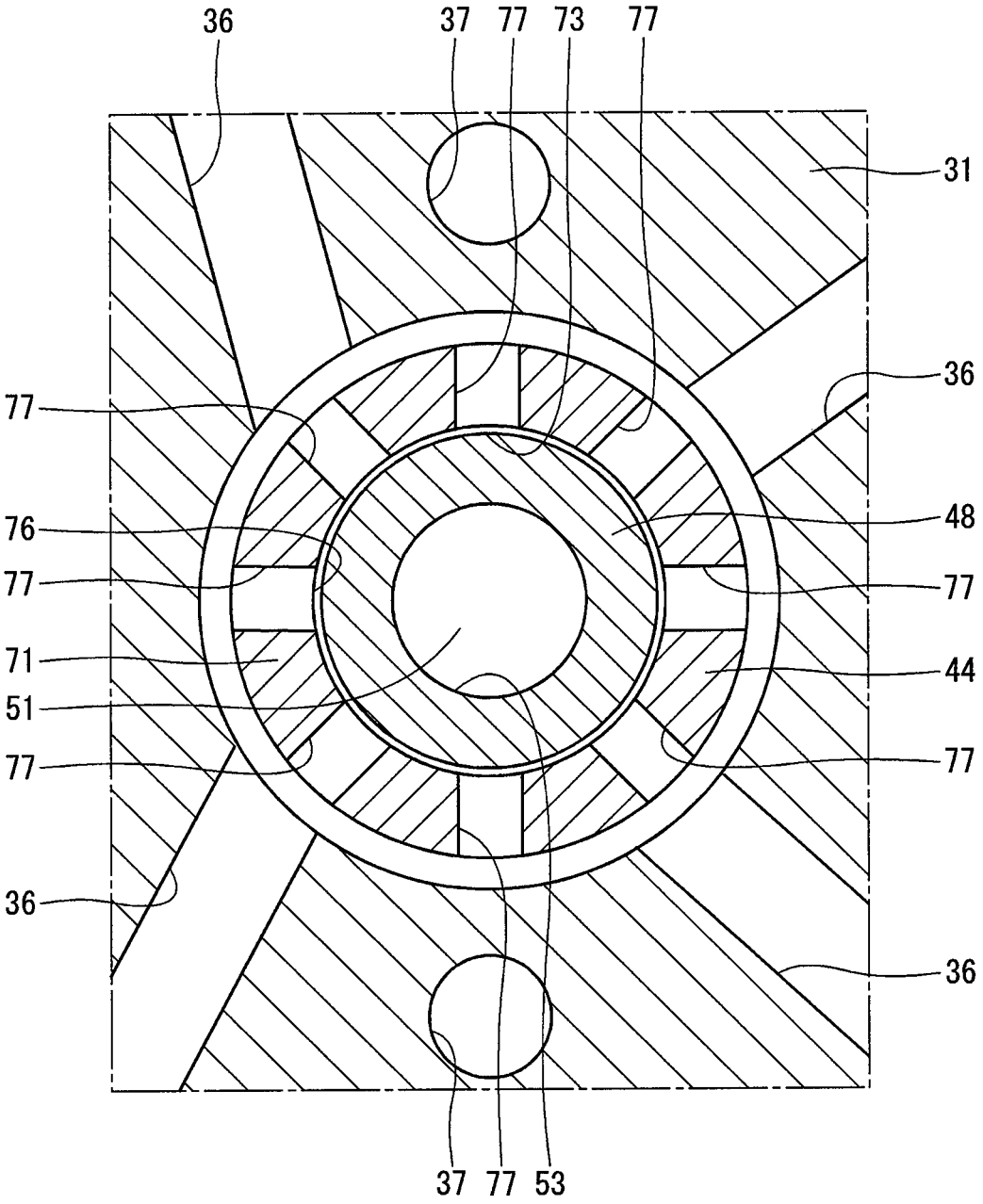
FIG. 6 is a sectional view taken along a line VI-VI of FIG. 3.

As shown in FIG. 3 and FIG. 6, the retard port 46 includes a retard recess 76 recessed outward in the radial direction from the inner wall surface 73 of the pipe part 71 of the valve body 44. In this embodiment, the retard port 46 includes the retard recess 76 that is an annular groove formed over all the circumferences of the valve body 44 around the axial center, and the plural through holes 76 extending radially from the retard recess 76. The retard recess 76 may equivalent to one drain recess.

Figure 7:
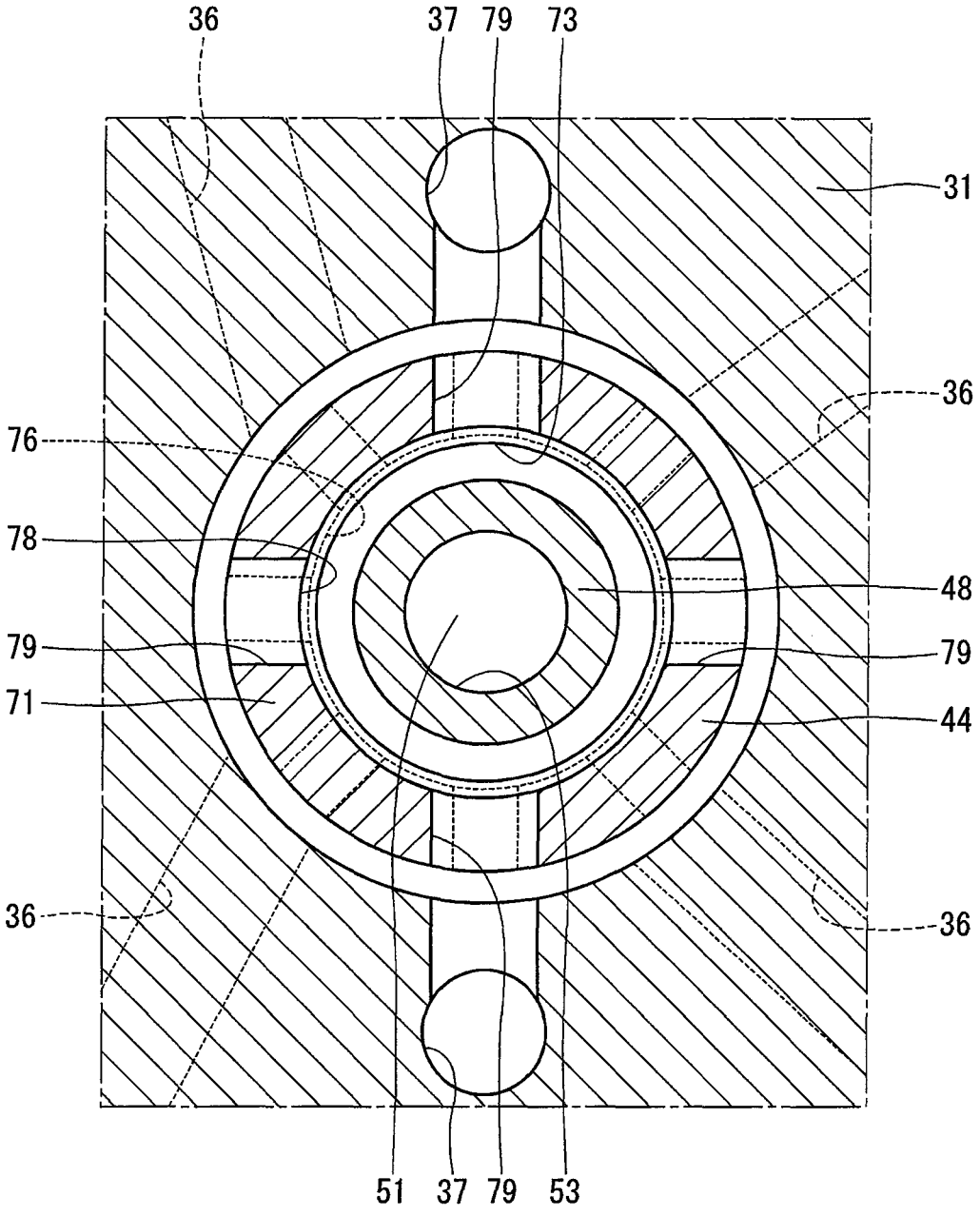
FIG. 7 is a sectional view taken along a line VII-VII of FIG. 3.

As shown in FIG. 3 and FIG. 7, the supply port 47 includes a supply recess 78 recessed outward in the radial direction from the inner wall surface 73 of the pipe part 71 of the valve body 44. In this embodiment, the supply port 47 includes the supply recess 78 that is an annular groove formed over all the circumferences of the valve body 44 around the axial center, and the plural through holes 79 extending radially from the supply recess 78.

As shown in FIG. 3, the depth H1 of the retard recess 76 in the radial direction is smaller than the depth H2 of the supply recess 78 in the radial direction. In this embodiment, the depth H1 of the retard recess 76 in the radial direction and the depth H3 of the advance recess 74 in the radial direction are 0.35 mm, and the depth H2 of the supply recess 78 in the radial direction is 0.65 mm.

A valve timing controller 200 of a comparison example is described with reference to FIGS. 14-16, in which the depth H4 of the retard recess 203 in the radial direction and the depth H5 of the advance recess 204 in the radial direction are 0.65 mm.

Figure 10:
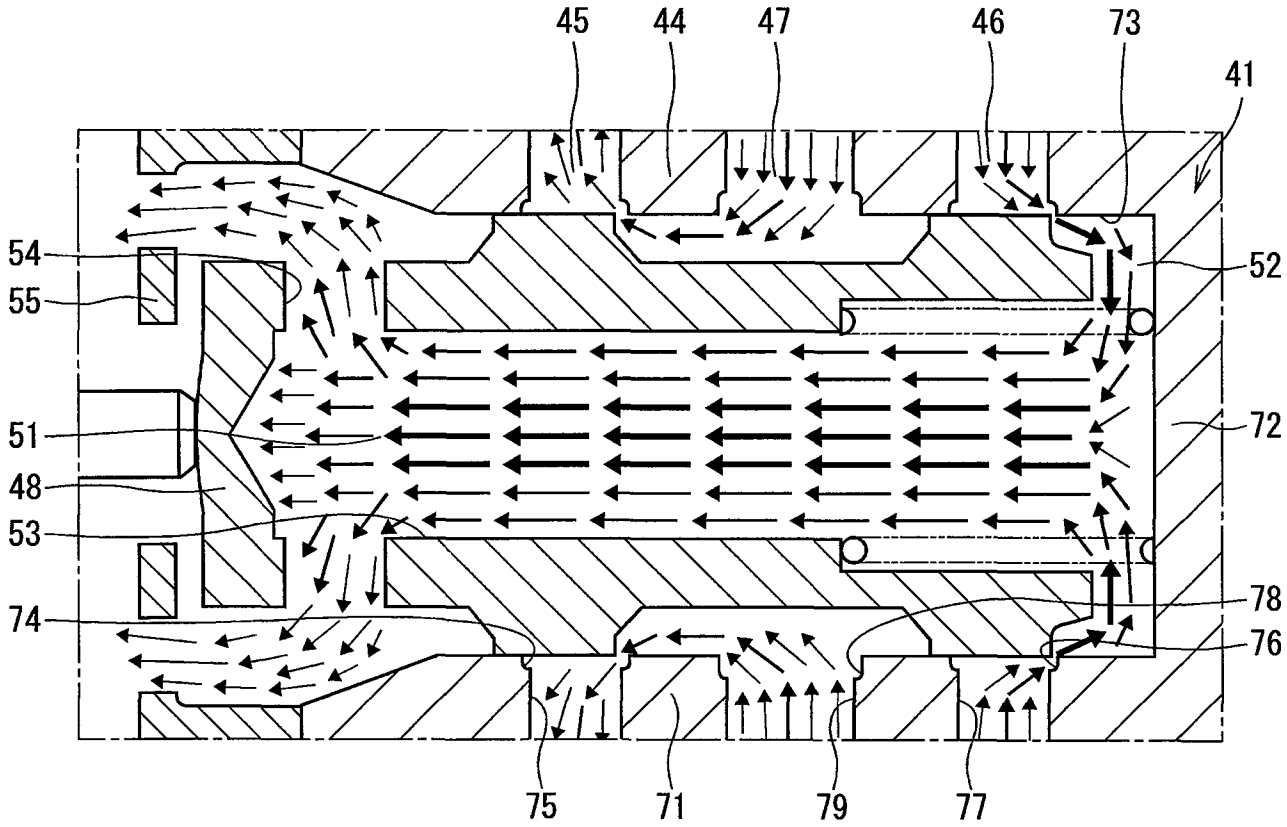
FIG. 10 is a diagram showing fluid force distribution in the cross-section of FIG. 8.
Figure 14:
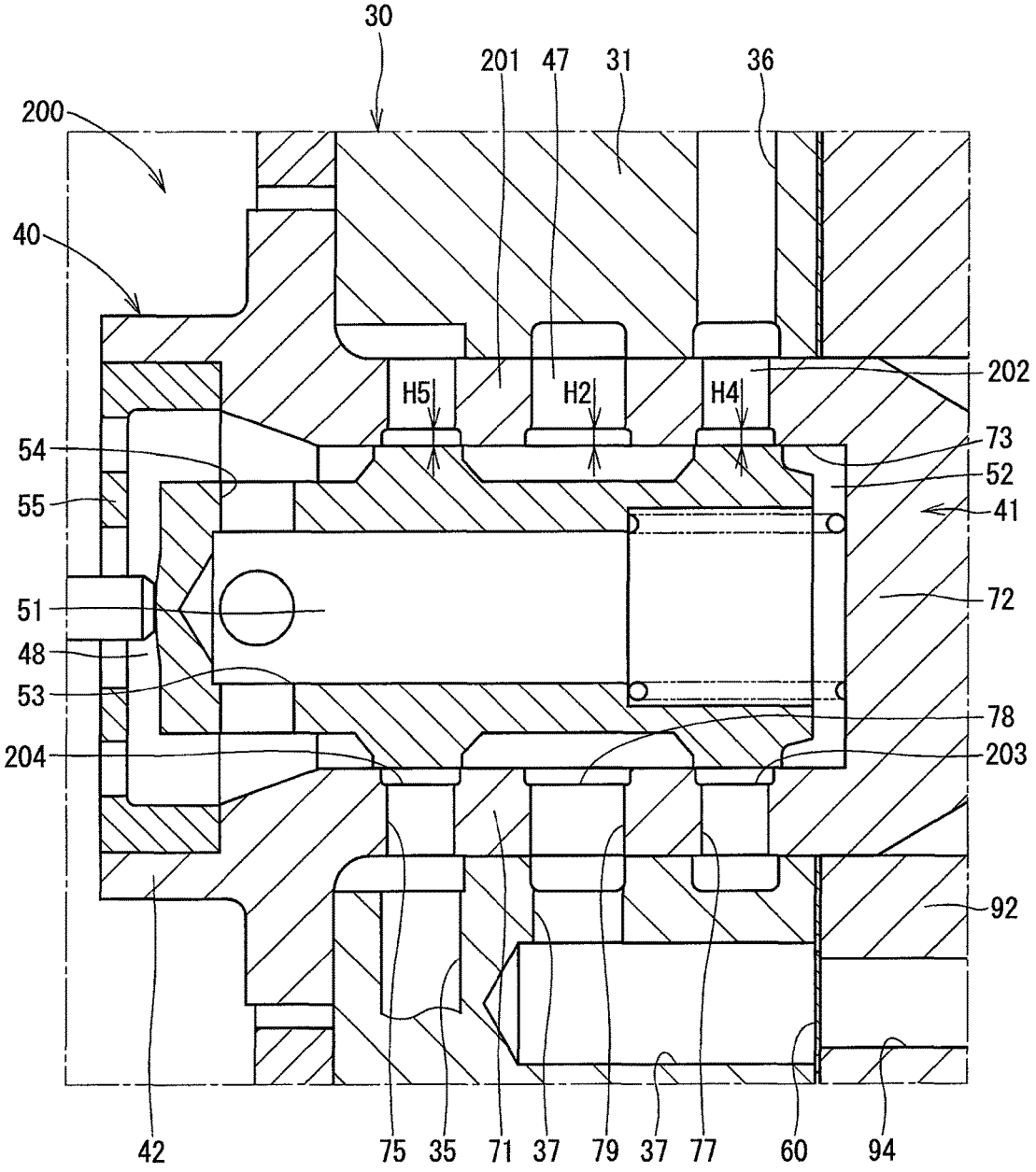
FIG. 14 is a partial sectional view illustrating a valve timing controller of a comparison example.

As shown in FIG. 14, in case where the valve timing controller 200 has the check valve 60, when the rotation phase of the vane rotor 30 is maintained, due to the check valve 60, the oil pressure in the advance chamber and in the retard chamber is maintained as comparatively high, almost the same as supply oil pressure. The supply oil pressure is a pressure of operation oil supplied to the external supply oil passage 94. From this state, when operation oil is discharged from a retard chamber through the retard port 202 located adjacent to the bottom 72 of the valve body 201, the oil pressure in the drain oil passage 51 near the retard recess 203 becomes high, as shown in FIG. 15, and a large amount of the operation oil flows into the drain oil passage 51, as shown in FIG. 16, because the difference pressure is large between the retard chamber and the drain oil passage 51 and because the open area of the retard recess 203 is rapidly increased. In FIG. 16 and FIG. 10, the arrows show the flowing directions of operation oil, and the thickness of the arrow represents the magnitude of fluid force.

Figure 11:
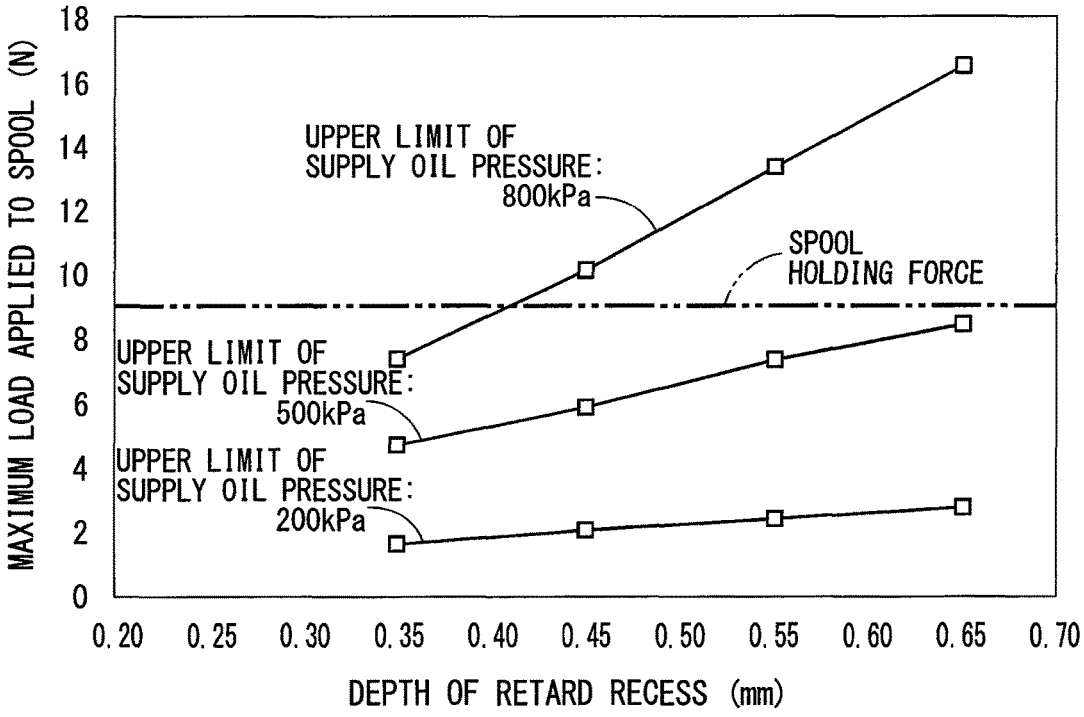
FIG. 11 is a graph illustrating a relationship between a depth of retard recess in a radial direction and a maximum load applied to a spool when discharging operation oil from the retard chamber, relative to conditions different in the upper limit of supply oil pressure.

Therefore, the high pressure of the operation oil of the drain oil passage 51 acts on the open end of the spool 48 which defines the drain space 52 with the valve body 201. The drain space 52 is a part of the drain oil passage 51. Moreover, the fluid force of the operation oil having the large flow rate in the drain oil passage 51 acts on the bottom of the spool 48 which receives the flow of the operation oil of the drain oil passage 51. As a result, as shown in FIG. 11, under the condition where the depth H4 of the retard recess 203 in the radial direction is 0.65 mm and where the upper limit of the supply oil pressure is 800 kPa, when operation oil is discharged from the retard chamber 34, the maximum load applied to the spool 48 exceeds 16N. Therefore, when discharging operation oil from the retard chamber 34, if the drawing force of the movable member of the linear solenoid 97, i.e., the minimum value of the spool holding force by the linear solenoid 97, is 9N, in the comparison example, the spool 48 may become unstable.

Figure 8:
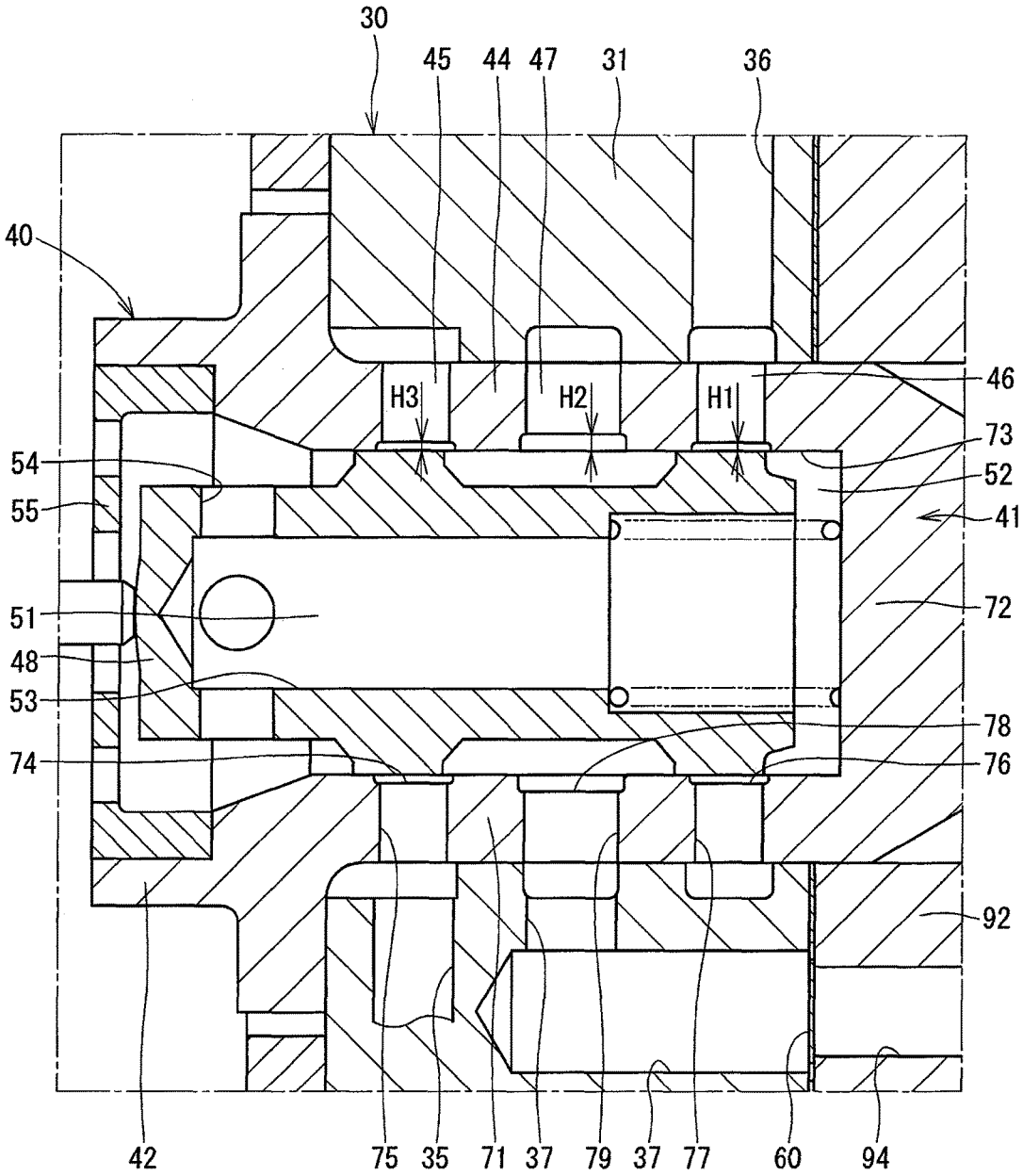
FIG. 8 is an enlarged sectional view showing an area III of FIG. 1, in which a state is shown immediately after a retard port is opened from a state in which the rotation phase is maintained.

In contrast, according to the first embodiment, as shown in FIG. 8, when operation oil is discharged from a retard chamber through the retard port 46 located adjacent to the bottom 72 of the valve body 44, pressure loss arises by narrowing the oil passage by the comparatively shallow retard recess 76. Thereby, compared with FIG. 16 representing the comparison example, as shown in FIG. 10, discharge of the excessive operation oil from the retard port 46 to the drain oil passage 51 is controlled.

Figure 9:
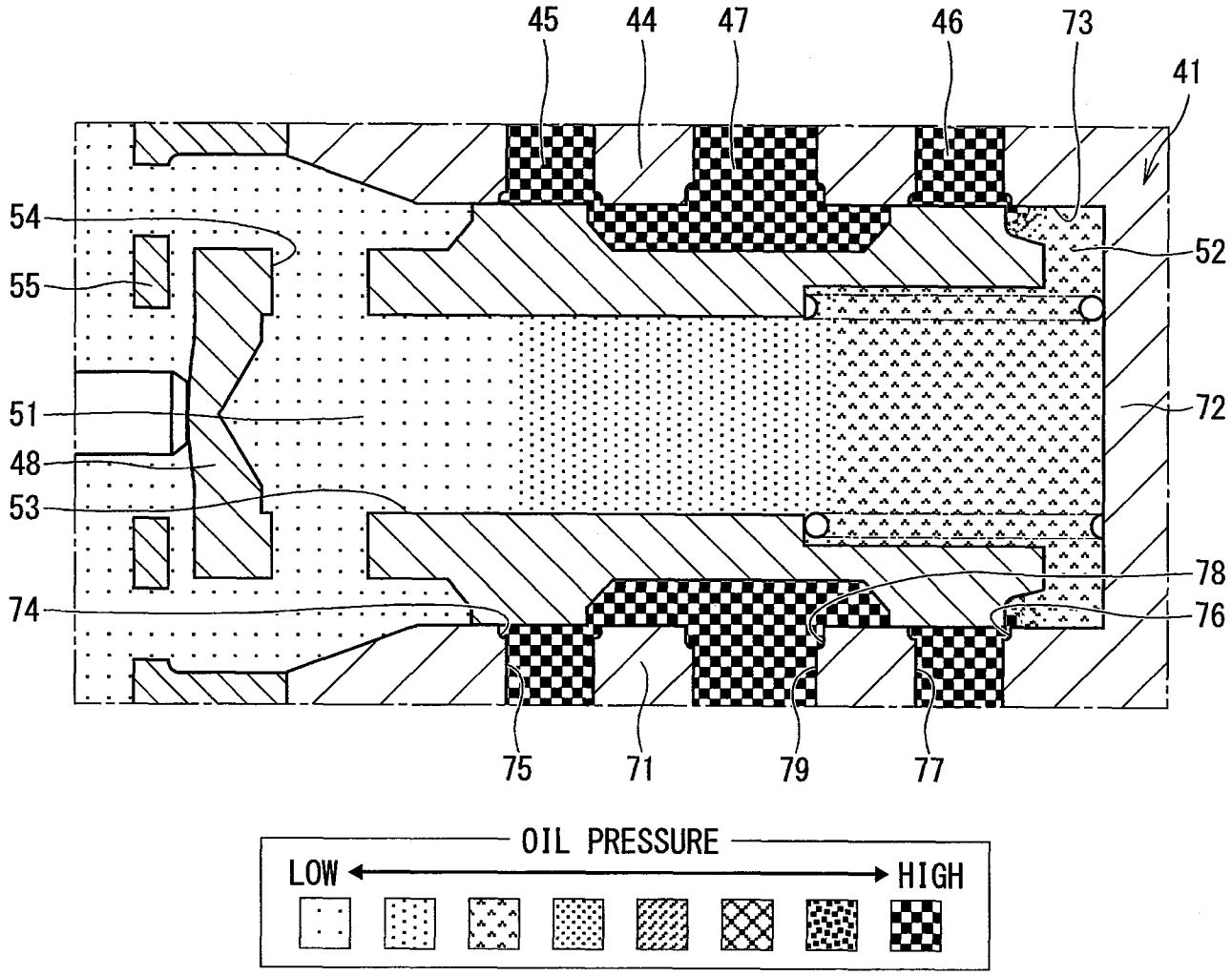
FIG. 9 is a diagram showing oil pressure distribution in the cross-section of FIG. 8.
Figure 15:
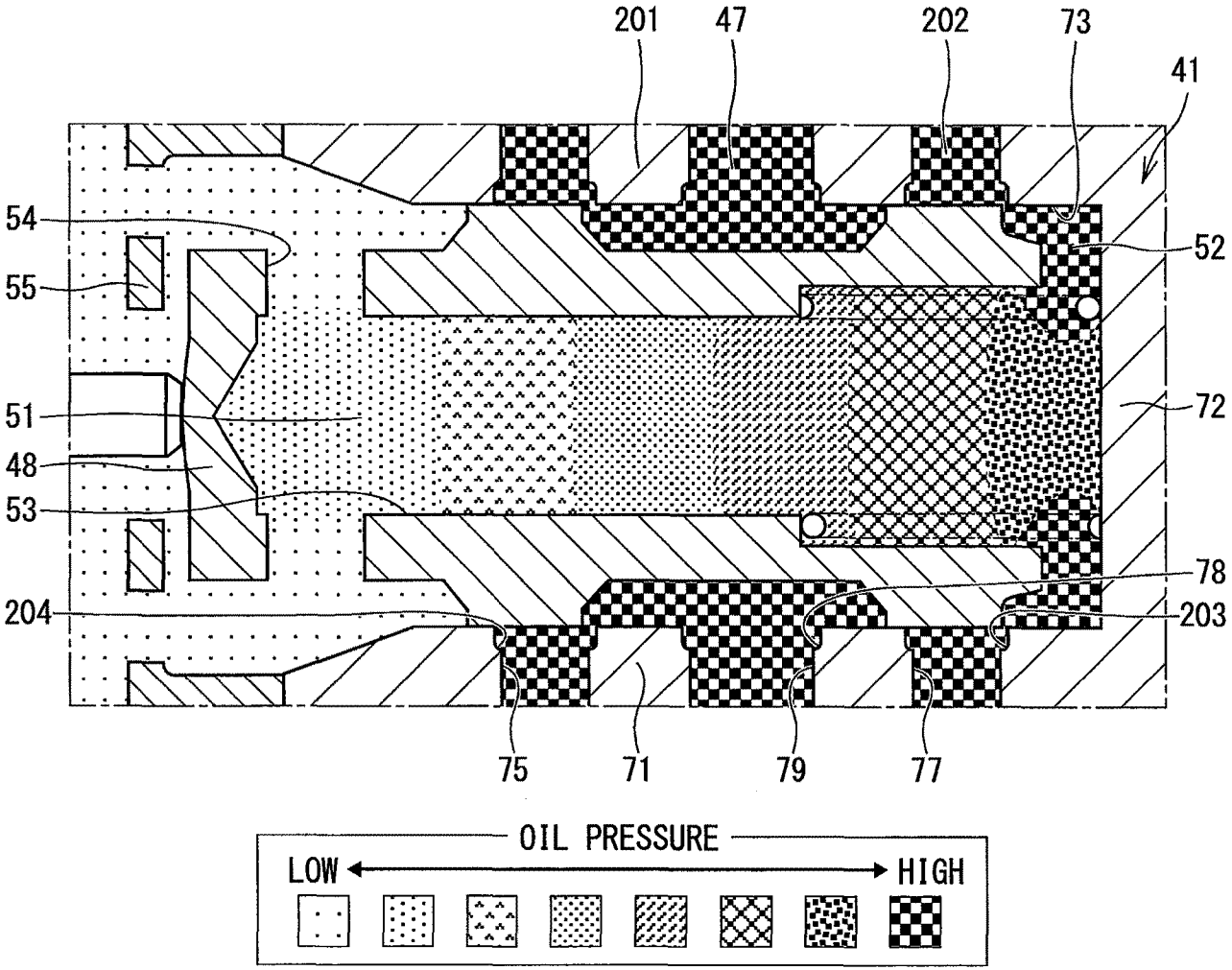
FIG. 15 is a diagram showing oil pressure distribution in the cross-section of FIG. 14.
Figure 16:
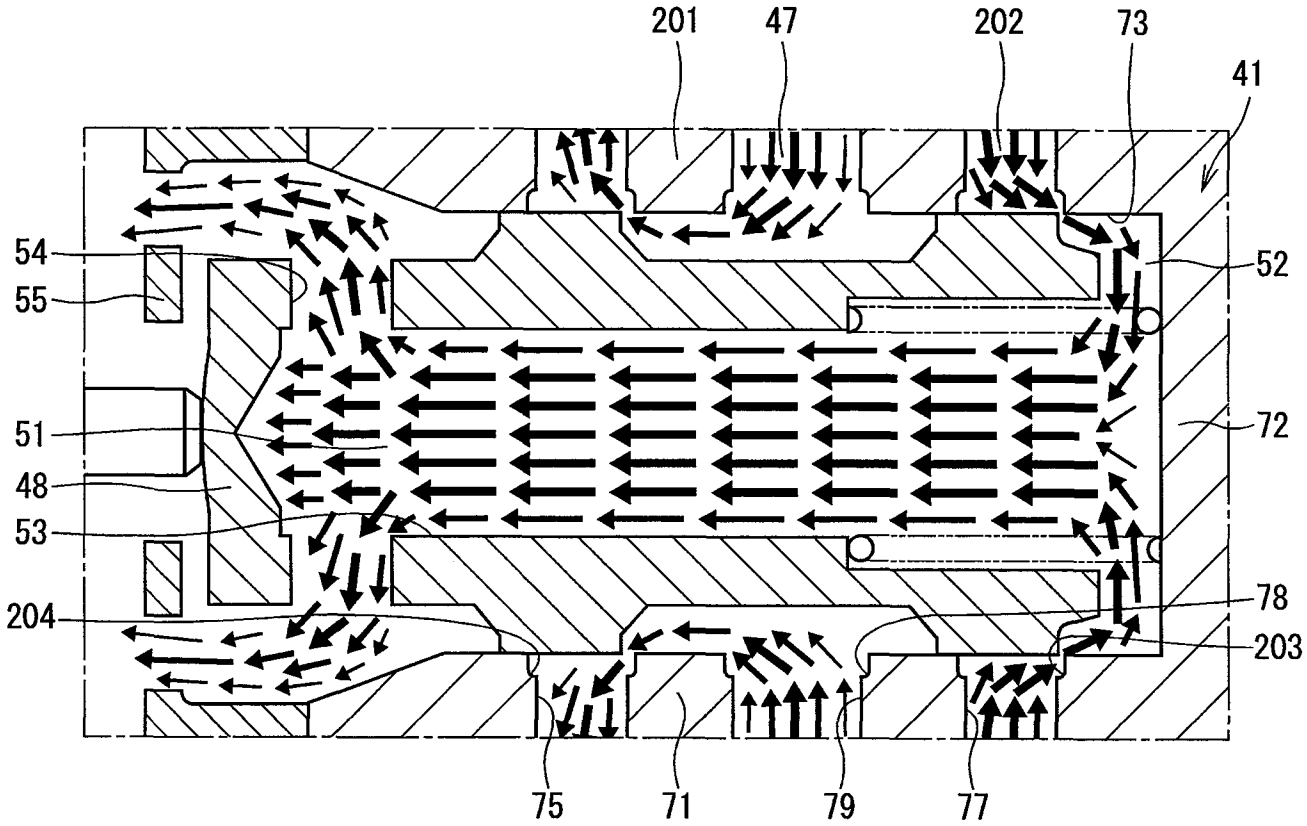
FIG. 16 is a diagram showing fluid force distribution in the cross-section of FIG. 14.

Moreover, compared with FIG. 15 representing the comparison example, as shown in FIG. 9, the oil pressure in the drain oil passage 51 near the retard port 46 is restricted from becoming high. As a result, as shown in FIG. 11, under the condition where the depth H1 of the retard recess 76 in the radial direction is 0.35 mm and where the upper limit of the supply oil pressure is 800 kPa, when operation oil is discharged from a retard chamber, the maximum load applied to the spool 48 is less than 8N. Therefore, according to the first embodiment, the spool 48 stably works when the minimum value of the spool holding force by the linear solenoid 97 is 9N.

If the supply recess 78 is not formed or is formed shallowly like the retard recess 76, most of the operation oil flowing out from the supply port will flow straightly toward the step part of the spool. At this time, the oil pressure in the supply port is almost the same as supply oil pressure, that is comparatively high. Therefore, large fluid force acts on the spool.

In contrast, according to the first embodiment, the supply recess 78 is comparatively deep. A part of the operation oil flowing out of the through hole 79 flows in the circumferential direction inside the supply recess 78, then, the operation oil flows toward the step part of the spool 48. Thus, the fluid force acting on the spool 48 can be reduced, and the spool 48 stably works.

According to the first embodiment, the valve body 44 has the based cylindrical shape, and has the supply port 47 to communicate with the external supply oil passage 94 of the camshaft 92, the advance port 45 to communicate with the advance chamber 33, and the retard port 46 to communicate with the retard chamber 34. The retard port 46 is located adjacent to the bottom 72 of the valve body 44 than the advance port 45 is The spool 48 defines the drain space 52 with the valve body 44, and opens the retard port 46 when discharging the operation oil of the retard chamber 34 to the drain space 52.

The supply port 47 includes the supply recess 78 recessed outward in the radial direction from the inner wall surface 73 of the pipe part 71 of the valve body 44. The retard port 46 includes the retard recess 76 recessed outward in the radial direction from the inner wall surface 73 of the pipe part 71. The depth H1 of the retard recess 76 in the radial direction is smaller than the depth H2 of the supply recess 78 in the radial direction.

When operation oil is discharged from the retard chamber 34 through the retard port 46 located adjacent to the bottom 72 of the valve body 44, pressure loss arises by narrowing the oil passage by the comparatively shallow retard recess 76. Thereby, operation oil is restricted from excessively discharged from the retard port 46 to the drain space 52, and the oil pressure in the drain space 52 is restricted from becoming high. Therefore, the spool 48 can stably work and the rotation phase of the vane rotor 30 can be controlled accurately.

According to the first embodiment, the radial depth H1 of the retard recess 76 is 0.35 mm. The inventor carries out experiments and numerical analysis, and finds out the following: under the condition where the upper limit of supply oil pressure is 800 kPa and where the radial depth H1 is 0.35 mm, sufficient effect can be acquired for controlling the oil discharge when operation oil is discharged through the retard port 46, and sufficient flow rate of operation oil can be acquired when operation oil is supplied through the retard port 46.

According to the first embodiment, the retard port 46 has the retard recess 76 that is the annular groove formed over all the circumferences of the valve body 44 around the axial center, and the plural through holes 77 formed to extend radially from the retard recess 76.

In the case where the retard recess is defined by an annular groove, if the radial depth of the retard recess is comparatively large like the comparison example, operation oil may blow off with high pressure from all the circumferences of the retard recess at the time of discharging operation oil.

In contrast, according to the first embodiment, the radial depth H1 of the retard recess 76 is comparatively small. As shown in FIG. 6, when operation oil flows in the circumferential direction inside the retard recess 76 from the edge of the through hole 77, large pressure loss arises at the time of discharging operation oil. Therefore, operation oil is restricted from flowing out of all the circumferences of the retard recess 76 at the time of discharging operation oil. Thus, excessive discharge of operation oil can be controlled.

According to the first embodiment, the advance port 45 is a port to discharge operation oil from the advance chamber 33 and is also a port to supply operation oil to the advance chamber 33. The retard port 46 is a port to discharge operation oil from the retard chamber 34 and is also a port to supply operation oil to the retard chamber 34.

Thus, even in a case where a supply port and a drain port are made common, sufficient oil discharge control effect can be obtained when operation oil is discharged and sufficient flow rate can be obtained when operation oil is supplied, by setting the radial depth H1 of the retard recess 76 and the radial depth H3 of the advance recess 204 as 0.35 mm.

Second Embodiment

Figure 12:
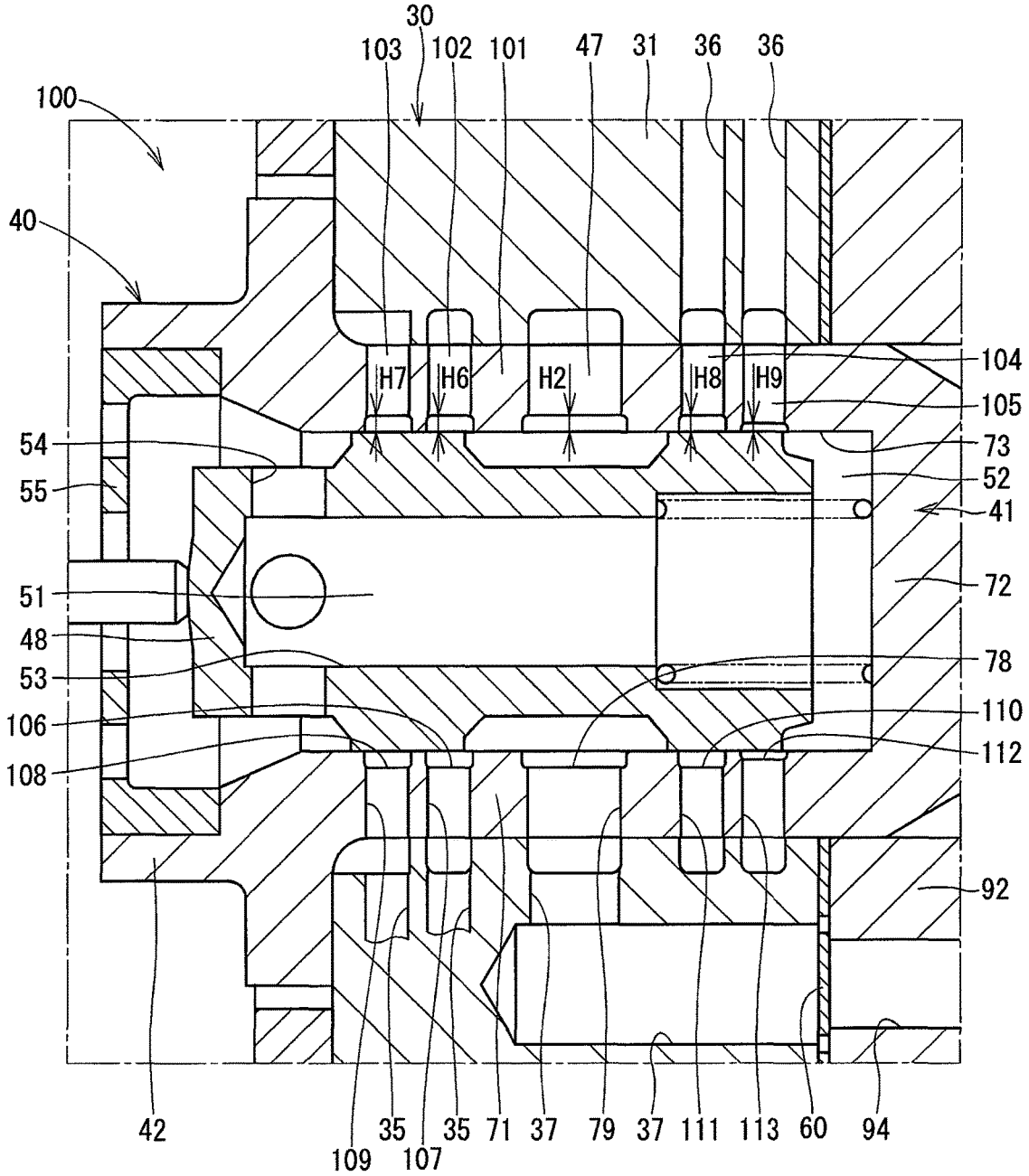
FIG. 12 is a partial sectional view illustrating a valve timing controller according to a second embodiment.

A valve timing controller 100 of a second embodiment is explained with reference to FIG. 12.

In the second embodiment, the valve body 101 has the first discharge port 102 to discharge operation oil to the advance chamber 33, the first drain port 103 to drain operation oil from the advance chamber 33, the second discharge port 104 to discharge operation oil to the retard chamber 34, and the second drain port 105 to drain operation oil from the retard chamber 34.

The first discharge port 102 has the first discharge recess 106 that is an annular groove formed over all the circumferences of the valve body 44 around the axial center, and the plural through holes 107 formed to extend radially from the first discharge recess 106.

The first drain port 103 has the first drain recess 108 that is an annular groove formed over all the circumferences of the valve body 44 around the axial center, and the plural through holes 109 formed to extend radially from the first drain recess 108. The first drain recess 108 may correspond to other drain recess.

The second discharge port 104 has the second discharge recess 110 that is an annular groove formed over all the circumferences of the valve body 44 around the axial center, and the plural through holes 111 formed to extend radially from the second discharge recess 110. The second discharge recess 110 may correspond to a discharge recess.

The second drain port 105 has the second drain recess 112 that is an annular groove formed over all the circumferences of the valve body 44 around the axial center, and the plural through holes 113 formed to extend radially from the second drain recess 112. The second drain recess 112 may correspond to a drain recess.

The radial depth H6 of the first discharge recess 106, the radial depth H7 of the first drain recess 108, and the radial depth H8 of the second discharge recess 110 are 0.65 mm. In contrast, the radial depth H9 of the second drain recess 112 is 0.35 mm. That is, the radial depth H9 is smaller than the radial depth H6, H7, H8.

According to the second embodiment, even in a case where the first drain port 103 is formed independently from the first discharge port 102, and the second drain port 105 is formed independently from the second discharge port 104, the accuracy of controlling the rotation phase of the vane rotor 30 can be kept high similarly to the first embodiment by setting the second drain recess 112 to be shallower than the first discharge recess 106, the first drain recess 108, and the second discharge recess 110.

Third Embodiment

Figure 13:
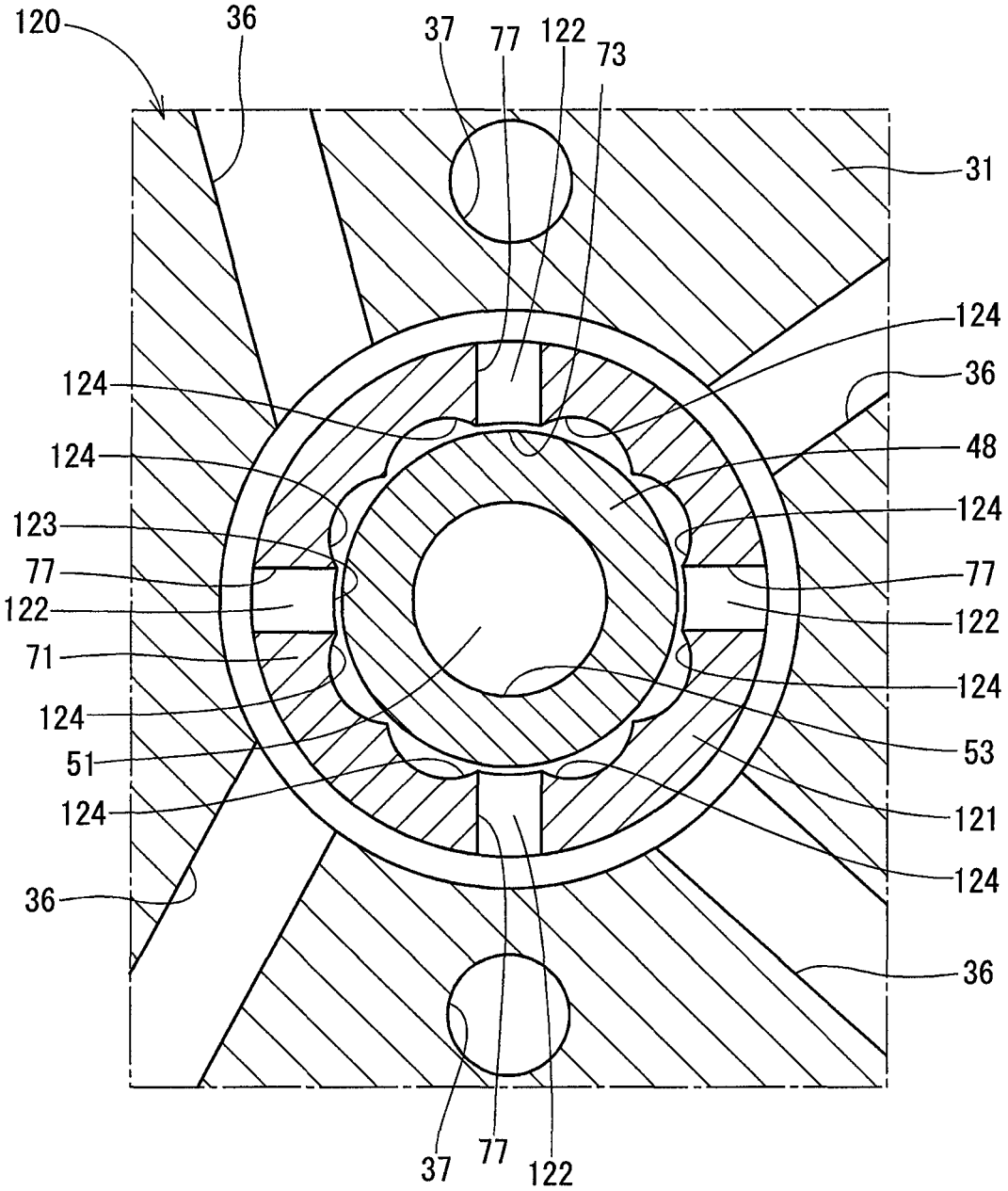
FIG. 13 is a partial sectional view illustrating a valve timing controller according to a third embodiment.

A valve timing controller 120 of a third embodiment is explained with reference to FIG. 13.

In the third embodiment, the second drain port 122 of the valve body 121 includes the second drain recess 123. The second drain recess 123 may correspond to a drain recess. As shown in FIG. 13, in a section perpendicular to the axial center, the second drain recess 123 has a diffuser part 124 that becomes deeper in the radial direction as separating from the edge of the through hole 113 in the circumferential direction. The dimension at the shallowest part of the diffuser part 124, i.e., the depth at the edge of the through hole 113 is set, for example, as 0.1-0.4 mm.

Therefore, at the time of discharging operation oil, large pressure loss arises when operation oil flows through the diffuser part 124 in the circumferential direction from the edge of the through hole 113. Since operation oil is restricted from flowing out of all the circumferences of the second drain recess 123 at the time of discharging operation oil, excessive discharge of operation oil can be controlled.

Other Embodiment

In other embodiment, a recess included in each port may not be an annular groove. That is, a port may be configured to include plural recesses with intervals in the circumferential direction.

In other embodiment, the radial depth of the retard recess and the radial depth of the second drain recess may not be 0.35 mm. In short, the radial depth of the retard recess and the radial depth of the second drain recess are not limited while being smaller than the radial depth of the supply recess.

In other embodiment, the radial depth of the advance recess may be equal to the radial depth of the supply recess, and may be larger than the radial depth of the retard recess.

In other embodiment, the valve timing controller may control valve timing of an exhaust valve of the internal combustion engine.

Such changes and modifications are to be understood as being within the scope of the present disclosure as defined by the appended claims.

What is claimed is:

1. A valve timing controller disposed in a passage where a driving force is transmitted from a driving shaft to a driven shaft of an internal combustion engine to control a valve timing of a valve driven to open and close by the driven shaft, the valve timing controller comprising:

a housing rotatable with one of the driving shaft and the driven shaft;

a vane rotor rotatable with the other of the driving shaft and the driven shaft, the vane rotor having a vane part that divides an interior space of the housing into a first oil pressure chamber on one side in a circumferential direction and a second oil pressure chamber on the other side in the circumferential direction;

a valve body having a based cylindrical shape including a pipe part and a bottom arranged coaxially with the vane rotor at a central part of the vane rotor, the valve body having a supply port to communicate with an external oil feed section, a first drain port to communicate with the first oil pressure chamber, and a second drain port to communicate with the second oil pressure chamber; and a spool movable in an axial direction inside of the pipe part of the valve body, the spool and the bottom of the valve body defining a drain space, the spool opening the second drain port that is located closer to the bottom of the valve body than the first drain port is when discharging operation oil of the second oil pressure chamber to a drain oil passage which includes the drain space, wherein the supply port includes a supply recess recessed outward in a radial direction from an inner wall surface of the pipe part of the valve body, the second drain port includes a first drain recess recessed outward in the radial direction from the inner wall surface of the pipe part, and a depth of the first drain recess in the radial direction is smaller than a depth of the supply recess in the radial direction.

2. The valve timing controller according to claim 1, wherein the spool is driven by a spool actuator, and a force of the spool actuator holding the spool at a position in the axial direction is defined as a spool holding force, the minimum value of the spool holding force is in a range of 8-10N when discharging operation oil of the second oil pressure chamber, a pressure of the operation oil supplied to the external oil feed section is less than or equal to 800 kPa, and the depth of the first drain recess in the radial direction is smaller than or equal to 0.35 mm.

3. The valve timing controller according to claim 1, wherein the second drain port includes the first drain recess that is an annular groove formed over all the circumferences of the valve body around an axial center, and a plurality of through holes extending radially from the first drain recess.

4. The valve timing controller according to claim 3, wherein the first drain recess has a diffuser part that becomes deeper in the radial direction as separating from the through hole in the circumferential direction in a cross-section perpendicular to the axial center.

5. The valve timing controller according to claim 1, wherein the first drain port is also a first discharge port to discharge the operation oil from the valve body to the first oil pressure chamber, and the second drain port is also a second discharge port to discharge the operation oil from the valve body to the second oil pressure chamber.

6. The valve timing controller according to claim 1, wherein the valve body has a first discharge port to discharge the operation oil to the first oil pressure chamber, and a second discharge port to discharge the operation oil to the second oil pressure chamber, and the first discharge port and the second discharge port are respectively separate from the first drain port and the second drain port.

7. The valve timing controller according to claim 6, wherein the second discharge port includes a discharge recess recessed outward in the radial direction from the inner wall surface of the pipe part, and the depth of the first drain recess in the radial direction is smaller than a depth of the discharge recess in the radial direction.

8. The valve timing controller according to claim 1, wherein the first drain port includes a second drain recess recessed outward in the radial direction from the inner wall surface of the pipe part, and the depth of the first drain recess in the radial direction is smaller than a depth of the second drain recess in the radial direction.

9. The valve timing controller according to claim 1, further comprising:

a spring that biases the spool, wherein the spring is arranged between the spool and the bottom of the valve body in the axial direction, and the drain space is defined between the bottom of the valve body and an end surface of the spool in the axial direction.

10. The valve timing controller according to claim 1, wherein the depth of the drain recess in the radial direction is defined to have a fixed diameter and to be a distance from the inner wall surface of the pipe part, and the depth of the supply recess in the radial direction is defined to have a fixed diameter and to be a distance from the inner wall surface of the pipe part.

11. The valve timing controller according to claim 1, wherein the supply port is located between the first drain port and the second drain port in the axial direction.

12. The valve timing controller according to claim 1, wherein the drain space is located between the bottom of the valve body and the second drain port in the axial direction.

* * * * *